US007438360B2

(12) United States Patent
Chung

(10) Patent No.: US 7,438,360 B2
(45) Date of Patent: Oct. 21, 2008

(54) ARMREST AND METHOD OF MAKING THE SAME

(76) Inventor: Pei-Chiang Chung, 3F, No. 21, Lane 83, Rong-Hsing St., Tou-Chia Tsun, Tan-Tzu Hsiang, Taichung Hsien (TW)

( * ) Notice: Subject to any disclaimer, the term of this patent is extended or adjusted under 35 U.S.C. 154(b) by 13 days.

(21) Appl. No.: 11/467,508

(22) Filed: Aug. 25, 2006

(65) Prior Publication Data

US 2008/0073964 A1 Mar. 27, 2008

(51) Int. Cl.
*A47C 7/00* (2006.01)
*A47C 7/54* (2006.01)

(52) U.S. Cl. ..... 297/411.2; 297/411.21; 297/411.46

(58) Field of Classification Search ..... 297/411.2, 297/411.46, 411.21, 41.21
See application file for complete search history.

(56) References Cited

U.S. PATENT DOCUMENTS

| | | | | |
|---|---|---|---|---|
| 4,089,497 | A * | 5/1978 | Miller et al. | 248/345.1 |
| 4,710,992 | A * | 12/1987 | Falwell et al. | 5/663 |
| 5,271,662 | A * | 12/1993 | Saul | 297/219.1 |
| 5,787,664 | A * | 8/1998 | Hollander et al. | 52/300 |
| 6,367,878 | B1 | 4/2002 | Chung | |
| 6,582,021 | B1 | 6/2003 | Chung | |

* cited by examiner

*Primary Examiner*—David R Dunn
*Assistant Examiner*—Erika Garrett
(74) *Attorney, Agent, or Firm*—Christie, Parker & Hale, LLP

(57) ABSTRACT

An armrest includes a longitudinal core body having a substantially planar bottom surface, a non-planar top surface, and two opposite lateral surfaces. The non-planar top surface rises upwardly from the lateral surfaces to a middle of the top surface of the core body. A top veneer layer has a top surface, and a bottom connecting surface adhered to the top surface of the core body. Each of the top and bottom connecting surfaces of the top veneer layer has substantially the same outline as that of the top surface of the core body. Two lateral veneer layers have top end faces connected to the bottom connecting surface of the top veneer layer, and inner lateral surfaces adhered respectively to the lateral surfaces of the core body.

10 Claims, 11 Drawing Sheets

ARMREST AND METHOD OF MAKING THE SAME

BACKGROUND OF THE INVENTION

1. Field of the Invention

The invention relates to an armrest, more particularly to an armrest that has an appealing appearance, that can be produced at a relatively low cost, and that is environmentally friendly, and the method of making the same.

2. Description of the Related Art

Referring to FIG. 1, a first conventional armrest 1, as disclosed in U.S. Pat. No. 6,367,878 B1, includes a longitudinal armrest body 11, a veneer layer 12, and two decorative ribs 13. The armrest body 11 is made of a lower-quality wood material, and has a planar bottom surface 111, a top surface 113, and two opposite lateral surfaces 112 that interconnect the bottom and top surfaces 111, 113. The veneer layer 12 is made of a higher-quality wood material, and is attached to the top and lateral surfaces 113, 112 of the armrest body 11 by means of an adhesive. The decorative ribs 13 are made of high-quality wood materials, and are fixed respectively to grooves 114 in the lateral surfaces 112 of the armrest body 11 proximate to two opposite ends of the veneer layer 12.

Although the cost of the first conventional armrest 1 is relatively low, the veneer layer 12 has to be heated first so that it can be bent to follow the contour of the armrest body 11. However, heating of the veneer layer 12 is likely to destroy the grain, gloss and pores of the veneer layer 12, thereby affecting an outer appearance of the first conventional armrest 1.

Referring to FIGS. 2, 3, and 4, a second conventional armrest 2, as disclosed in U.S. Pat. No. 6,582,021 B1, is shown to include an armrest body 21, a top veneer layer 22, and two lateral veneer layers 23. The armrest body 21 is made of a lower-quality wood material, extends in a longitudinal direction, and has a planar bottom surface 211, a planar top surface 212, and two lateral surfaces 213 interconnecting the bottom and top surfaces 211, 212. The top veneer layer 22 is made of a higher-quality wood material, and has a top surface 221, and a planar bottom surface 222 adhered to the top surface 212 of the armrest body 21. Each of the lateral veneer layers 23 is made of a material similar to that of the top veneer layer 22, and has a top end face 231 connected to the bottom surface 222 of the top veneer layer 22, a bottom end face 232 opposite to the top end face 231, inner side faces 233 adhered respectively to the lateral surfaces 213 of the armrest body 21, and outer side faces 234 opposite to the inner side faces 233.

The method of making the second conventional armrest 2 includes the steps of: adhering two lateral veneer blanks 230 to two opposite lateral surfaces of a longitudinal core body 210, respectively; adhering a top veneer blank 220 to a top surface of the core body 210 and top end faces of the lateral veneer blanks 230; lathing the top veneer blank 220 to form the contoured top surface 221 of the top veneer layer 22 of the armrest body 21; and, machining the lateral veneer blanks 230 to form the contoured outer side faces 234 of the lateral veneer layers 23 of the armrest body 21.

Although the second conventional armrest 2 conveys a high quality wood appearance in view of the top and lateral veneer layers 22, 23, it has the following drawbacks:

1. The top veneer layer 22 still consumes a large amount of the higher-quality wood material. Since the higher-quality wood material is expensive, the production cost of the second conventional armrest 2 is relatively high.

2. Since the consumption of the higher-quality wood material is high, the second conventional armrest 2 is not very environmentally friendly.

SUMMARY OF THE INVENTION

Therefore, the object of the present invention is to provide an armrest that is capable of overcoming the aforementioned drawbacks of the prior art.

Another object of the present invention is to provide a method of producing an armrest from an environmentally friendly wood composite.

According to this invention, an armrest comprises a longitudinal core body, a top veneer layer, and two lateral veneer layers. The longitudinal core body is made of a lower-quality wood material, and has a substantially planar bottom surface, a non-planar top surface, and two opposite lateral surfaces interconnecting the bottom and top surfaces and extending longitudinally. The non-planar top surface rises upwardly from the lateral surfaces to a middle of the top surface. The lower-quality wood material is selected from the group consisting of rubber wood, pinewood, cedar wood, defective high quality wood, and high density fiber material. The top veneer layer is made of a higher-quality wood material, and has a top surface, and a bottom connecting surface adhered to the top surface of the core body. Each of the top surface of the top veneer layer and the bottom connecting surface has substantially the same outline as that of the top surface of the core body. The higher-quality wood material is selected from the group consisting of oakwood, maple wood, poplar wood, cherry wood, beech wood, alder wood, and hemlock wood. Each of the lateral veneer layers is made of a material similar to that of the top veneer layer, and has a top end face connected to the bottom connecting surface of the top veneer layer, a bottom end face opposite to the top end face, an inner lateral surface adhered to a respective one of the lateral surfaces of the core body, and an outer lateral surface opposite to the inner lateral surface.

According to another aspect of this invention, a method of producing an armrest comprises the steps of: (A) preparing a longitudinal core blank from a lower-quality wood material; (B) attaching two lateral veneer blanks to two opposite lateral surfaces of the core blank, respectively; (C) contouring the core blank and the lateral veneer blanks so that the core blank has a contoured non-planar top surface and each of the lateral veneer blanks has a contoured top end face, the non-planar top surface rising upwardly from the lateral surfaces of the core blank to a middle of the top surface of the core blank; (D) preparing a top veneer blank; (E) bending the top veneer blank, and adhering a bottom connecting surface of the top veneer blank to the non-planar top surface of the core blank and the top end faces of the lateral veneer blanks; and (F) contouring the top veneer blank and the lateral veneer blanks.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
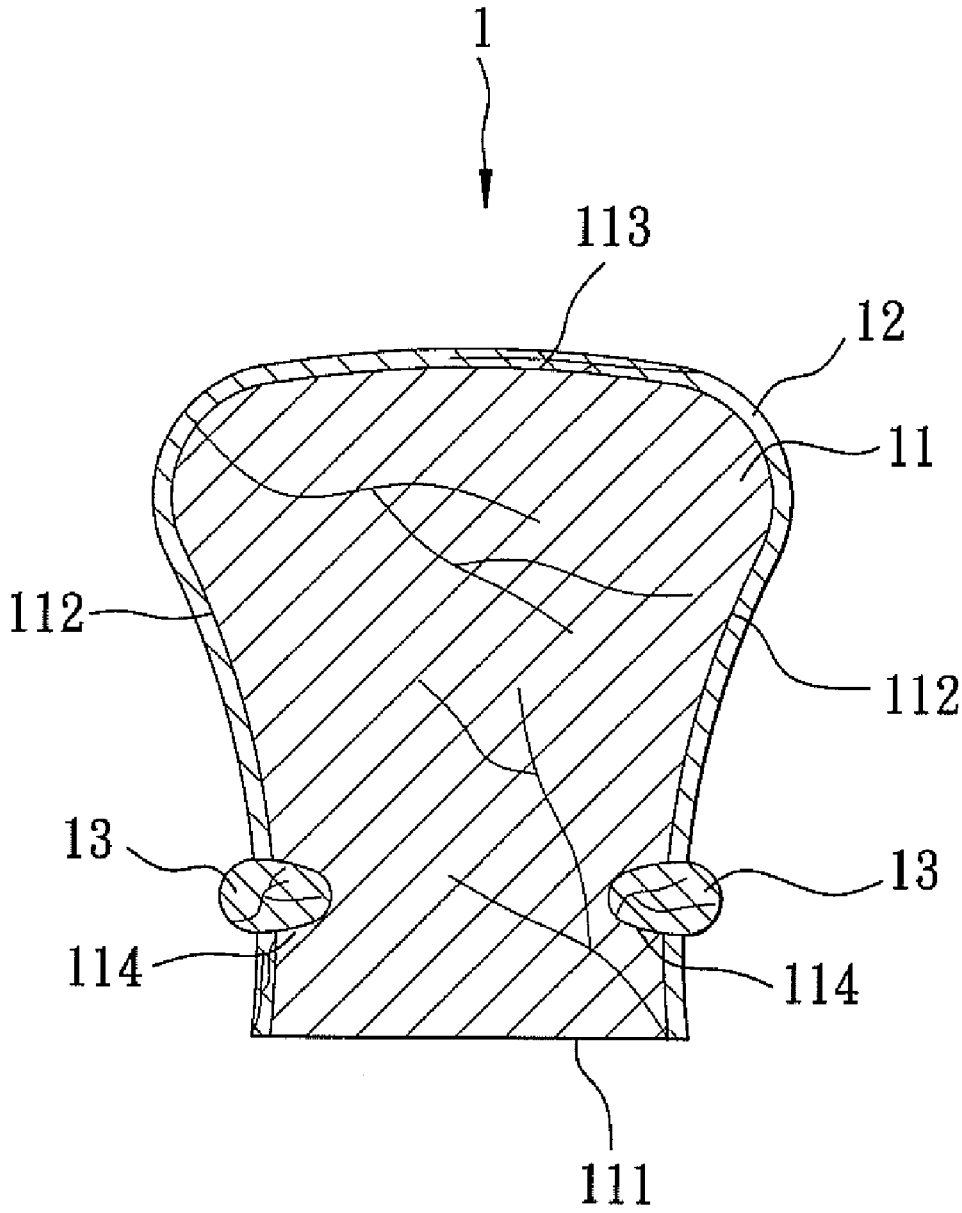
FIG. 1 PRIOR ART
FIG. 1 illustrates a first conventional armrest disclosed in U.S. Pat. No. 6,367,878 B1.

Before the present invention is described in greater detail, it should be noted that like elements are denoted by the same reference numerals throughout the disclosure.

Figure 5:
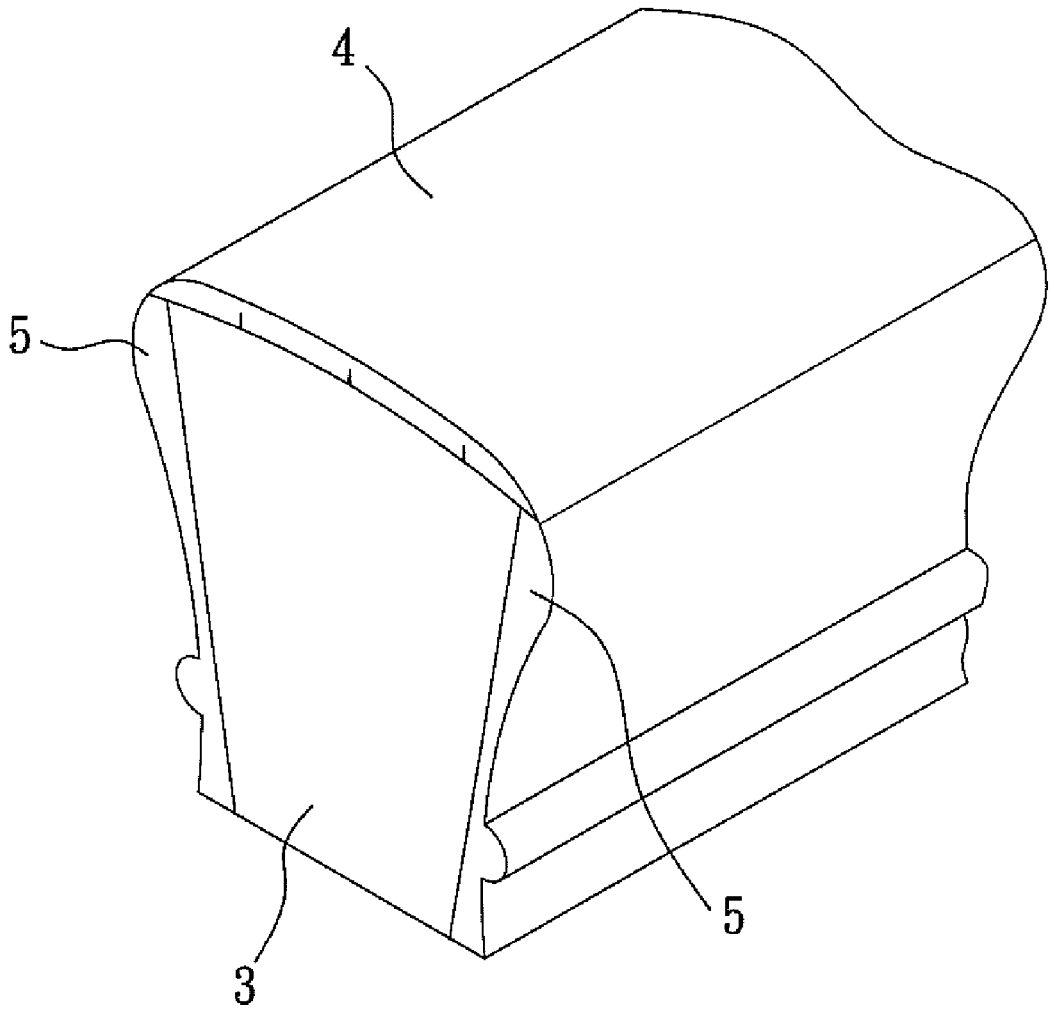
FIG. 5 is a perspective view of the first preferred embodiment of an armrest according to the present invention.
Figure 6:
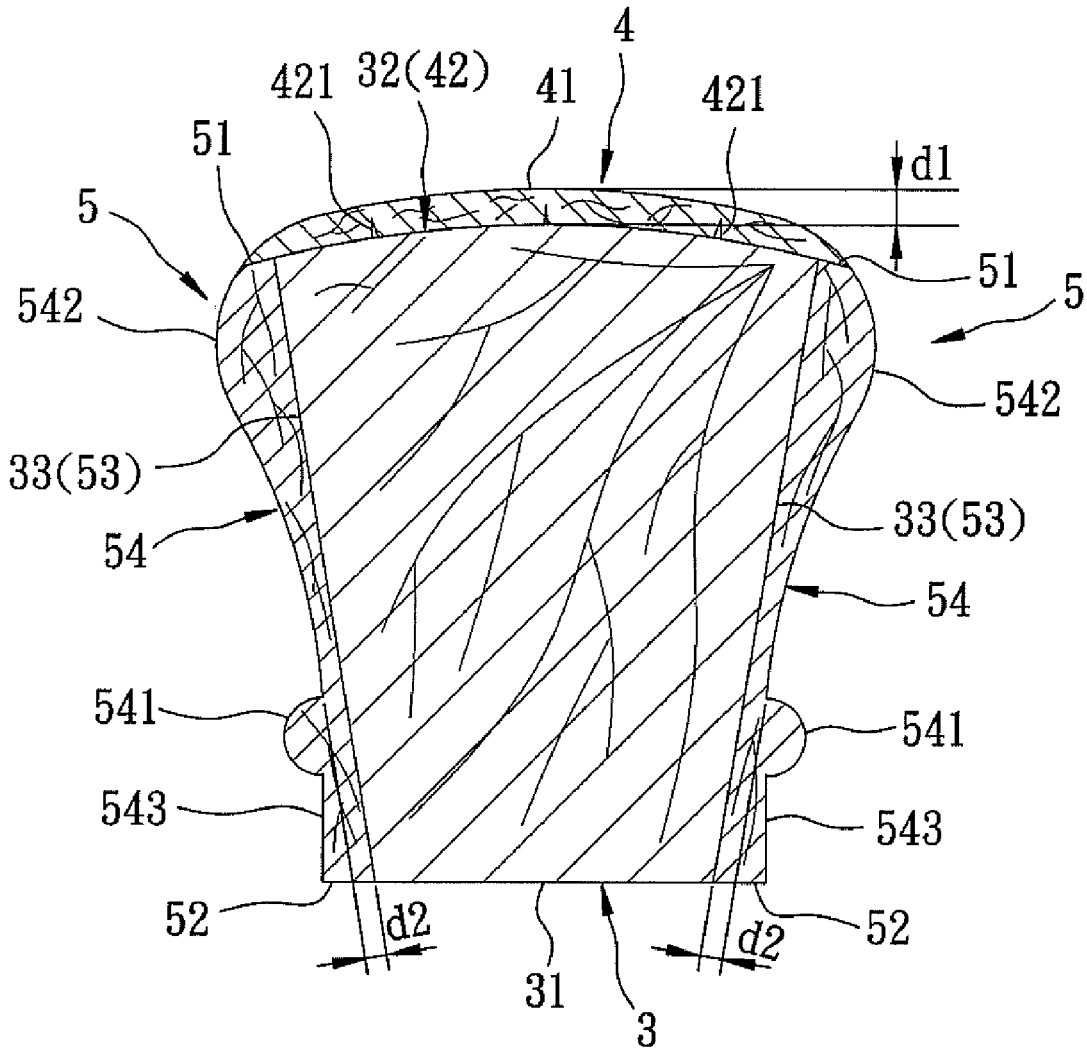
FIG. 6 is a sectional view of the first preferred embodiment.

Referring to FIGS. 5 and 6, the first preferred embodiment of an armrest according to the present invention is shown to comprise a longitudinal core body 3, a top veneer layer 4, and two lateral veneer layers 5.

The longitudinal core body 3 is made of a lower-quality wood material, which is selected from the group consisting of rubber wood, pinewood, cedar wood, defective higher-quality wood, and high density fiber material. The longitudinal core body 3 has a substantially planar bottom surface 31, a non-planar top surface 32, and two opposite lateral surfaces 33 interconnecting the bottom and top surfaces 31, 32 and extending longitudinally. In this embodiment, the non-planar top surface 32 is convexed upward, and rises upwardly from the lateral surfaces 33 to a middle of the top surface 32.

The top veneer layer 4 is made of a higher-quality wood material, which is selected from the group consisting of oakwood, maple wood, poplar wood, cherry wood, beech wood, alder wood, and hemlock wood. The top veneer layer 4 has a top surface 41 that is contoured according to a predetermined design, and a non-planar bottom connecting surface 42 adhered to the top surface 32 of the core body 3. Each of the top surface 41 and the bottom connecting surface 42 has substantially the same outline as that of the top surface 32 of the core body 3. The top veneer layer 4 is formed with a plurality of longitudinal grooves 421 that extend upwardly from the bottom connecting surface 42 to a level lower than the top surface 41 and that are spaced apart from each other transversely of the core body 3. Each of the longitudinal grooves 421 has a triangular cross-section. A central portion of the top veneer layer 4 has a thickness (d1) of not less than one millimeter.

Each of the lateral veneer layers 5 is made of a material similar to that of the top veneer layer 4, and has a top end face 51 connected to the bottom connecting surface 42 of the top veneer layer 4, a bottom end face 52 opposite to the top end face 51, a planar inner lateral surface 53 adhered to a respective one of the lateral surfaces 33 of the core body 3, and an outer lateral surface 54 opposite to the inner lateral surface 53 and that is contoured according to a predetermined design. The outer lateral surface 54 of each lateral veneer layer 5 includes a projection 541 extending longitudinally and projecting outwardly from the outer lateral surface 54, a curved surface section 542 extending from a top end of the projection 541 to the top end face 51 of the corresponding lateral veneer layer 5, and a substantially planar surface section 543 extending from a bottom end of the projection 541 to the bottom end face 52 of the corresponding lateral veneer layer 5. Each lateral veneer layer 5 has a smallest thickness (d2) of not less than one millimeter.

Figure 7:
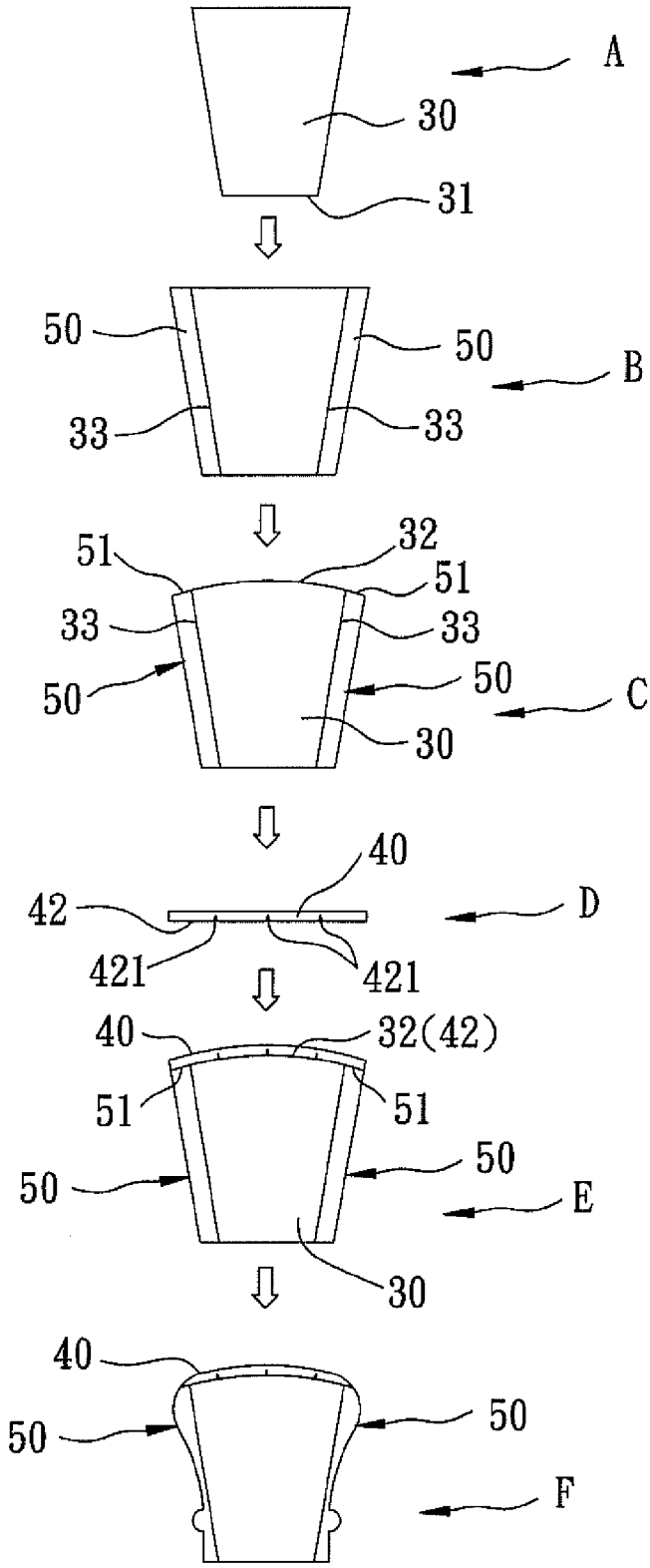
FIG. 7 illustrates the steps involved in producing the armrest of the first preferred embodiment.

With reference to FIG. 7, the method of producing the armrest of the first preferred embodiment includes steps (A) to (F).

In step (A), a longitudinal core blank 30 is prepared from a lower-quality wood material. The material is selected from the group consisting of rubber wood, pinewood, cedar wood, defective higher quality wood, and high density fiber material.

In step (B), two lateral veneer blanks 50 are attached respectively to two opposite lateral surfaces 33 of the core blank 30. Each of the lateral veneer blanks 50 is made of a material selected from the group consisting of oakwood, maple wood, poplar wood, cherry wood, beech wood, alder wood, and hemlock wood.

In step (C), the core blank 30 and the lateral veneer blanks 50 are contoured so that the core blank 30 has a contoured non-planar top surface 32 and each of the lateral veneer blanks 50 has a contoured top end face 51. The non-planar top surface 32 rises upwardly from the lateral surfaces 33 of the core blank 30 to a middle of the top surface 32 of the core blank 30. In particular, the non-planar top surface 32 is an upwardly convexed surface.

In step (D), a top veneer blank 40 is prepared, and has a bottom connecting surface 42 provided with a plurality of transversely spaced-apart longitudinal grooves 421 to ease bending of the top veneer blank 40. The top veneer blank 40 is made of a material similar to those of the lateral veneer blanks 50.

In step (E), the top veneer blank 40 is bent, and the bottom connecting surface 42 thereof is adhered to the non-planar top surface 32 of the core blank 30 and the top end faces 51 of the lateral veneer blanks 50. As the top veneer blank 40 is bent, the grooves 421 deform, and open ends of the grooves 421 are closed.

In step (F), the top veneer blank 40 and the lateral veneer blanks 50 are contoured to have the shapes shown in FIGS. 5 and 6.

The advantages of the armrest of the first preferred embodiment can be summarized as follows:

1. Due to the presence of the longitudinal grooves 421 in the bottom connecting surface 42 of the top veneer layer 4, the top veneer layer 4 can be bent easily so as to conform to the contour of the top surface 32 of the core body 3 and be adhered thereon, thereby dispensing with the need for heating the top veneer layer 4 as required in the aforesaid first conventional armrest 1 (see FIG. 1). As such, the grain, gloss and pores of the top veneer layer 4 can be maintained.

Figure 2:
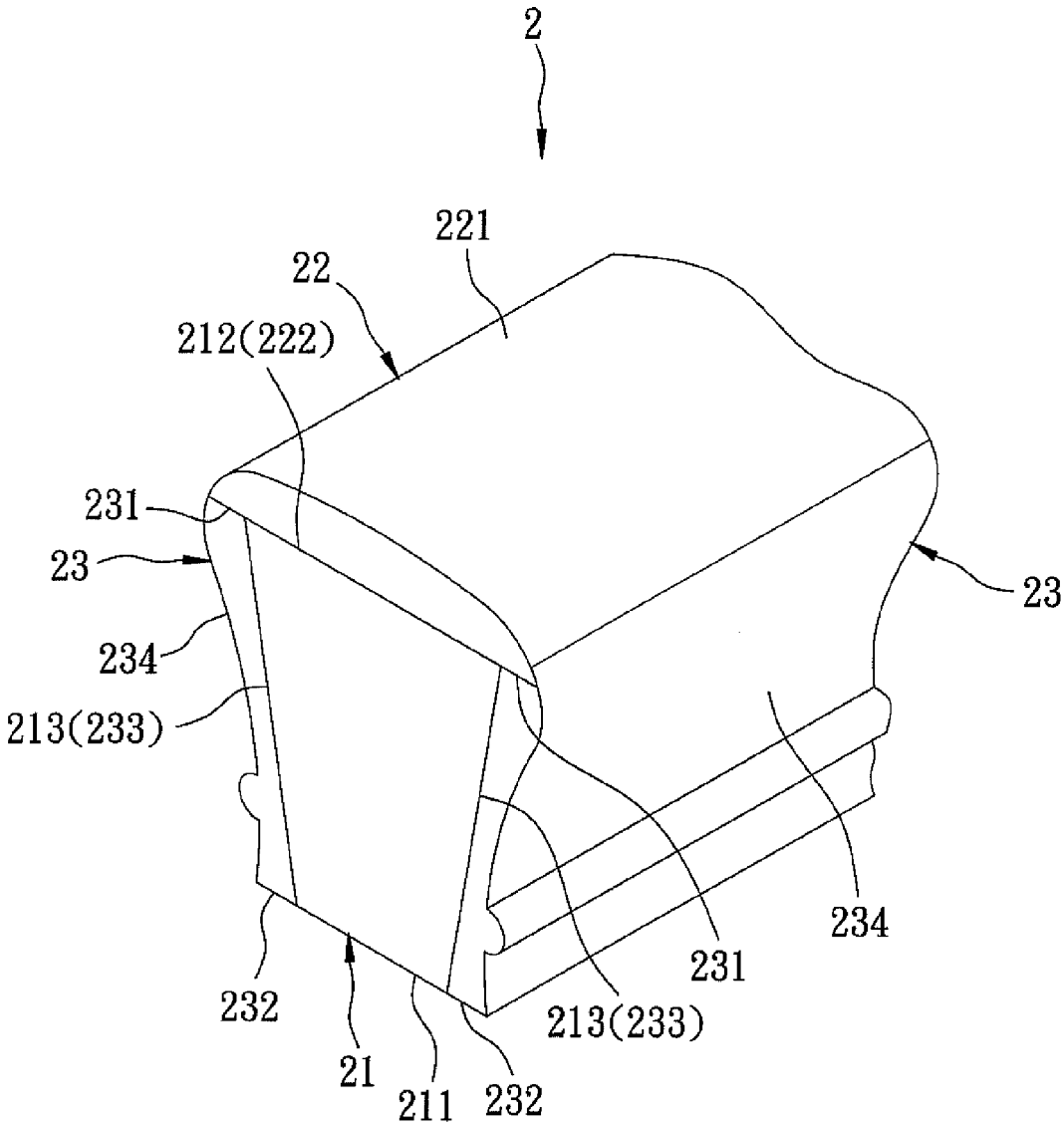
FIG. 2 PRIOR ART
FIG. 2 illustrates a second conventional armrest disclosed in U.S. Pat. No. 6,582,021 B1.
Figure 3:
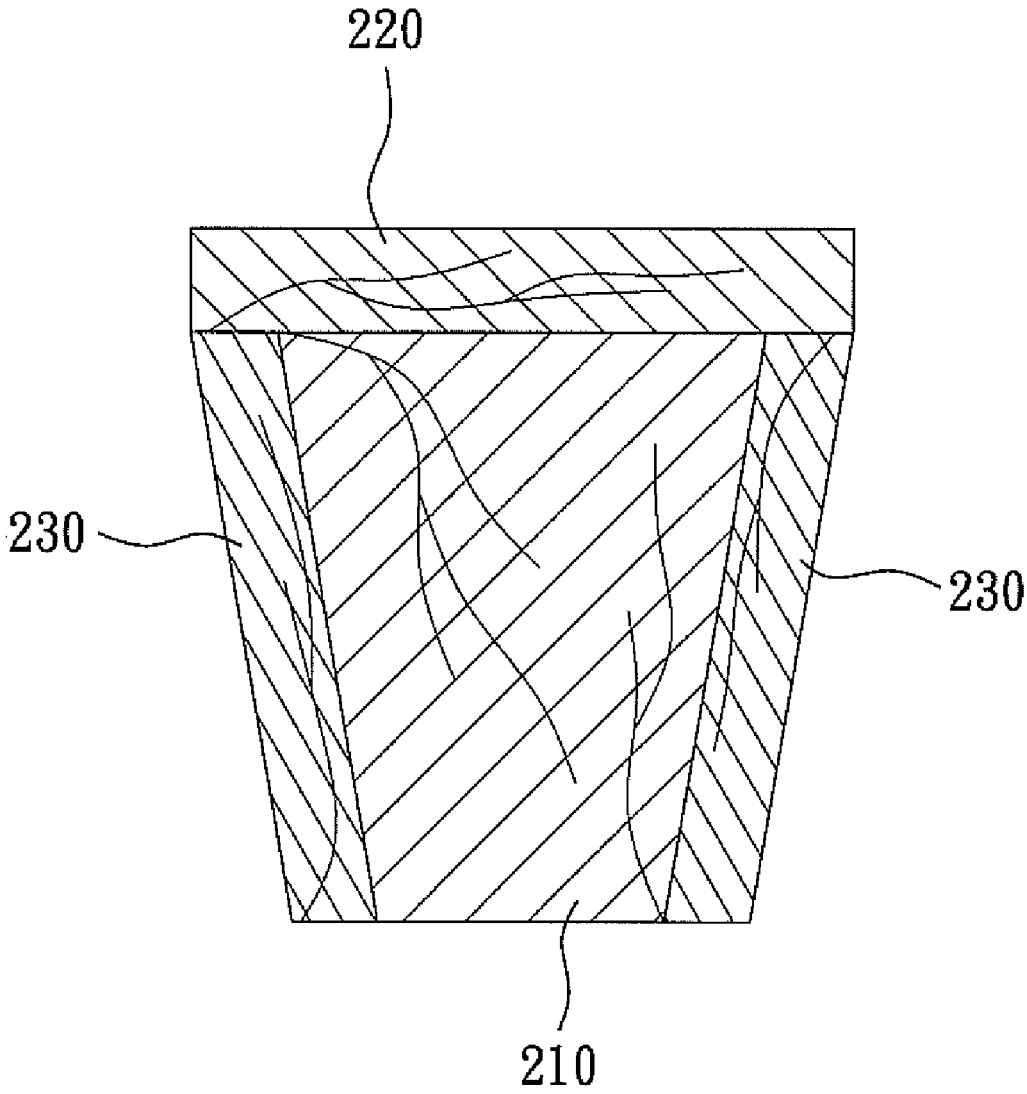
FIG. 3 PRIOR ART
FIG. 3 is an assembled sectional view of a core body, a top veneer blank, and two lateral veneer blanks used in making the second conventional armrest.
Figure 4:
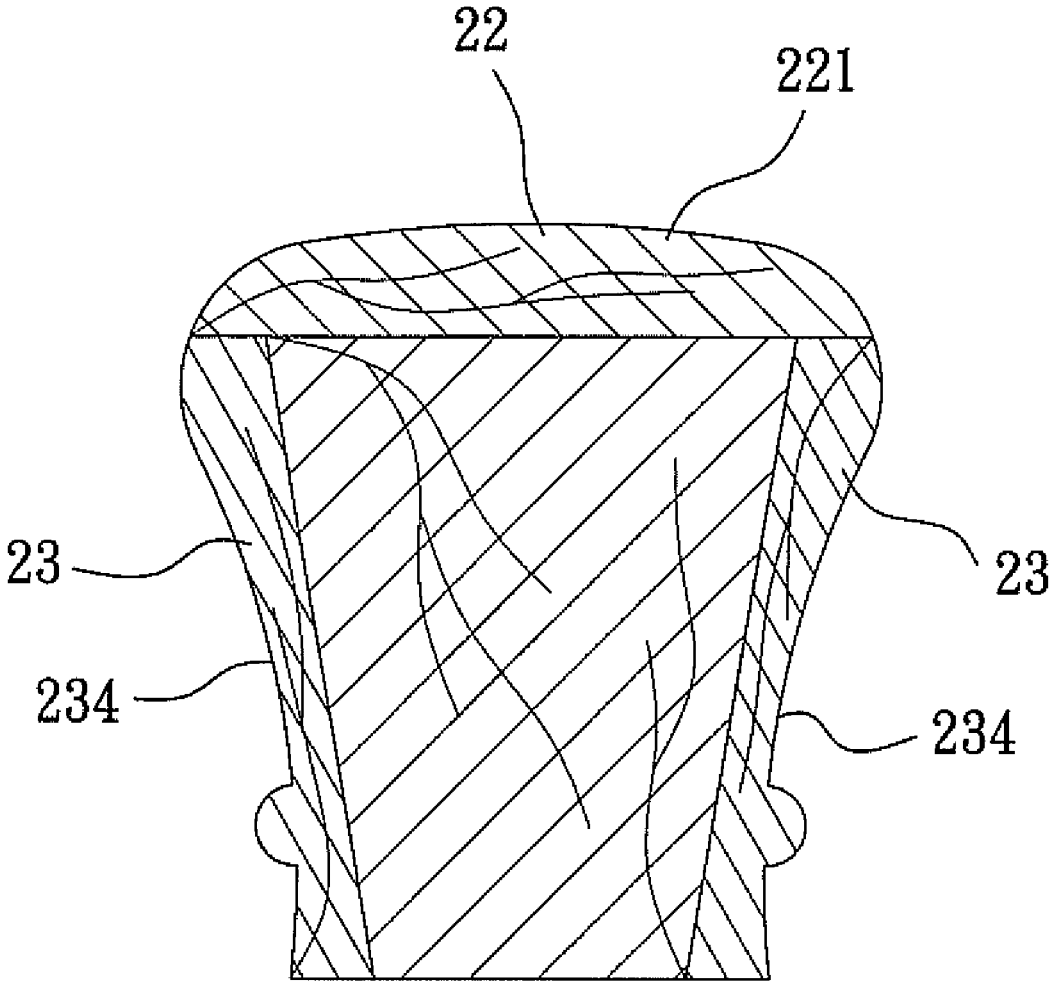
FIG. 4 PRIOR ART
FIG. 4 is a view similar to FIG. 3, but with the core body and the blanks forming the second conventional armrest after undergoing a machining process.

2. Because the top surface of the core blank 30 is contoured to be non-planar or to rise upwardly at the middle thereof, the top veneer blank 40 does not have to be provided with an increased thickness at the center thereof, which is required in the second conventional armrest 2 (see FIGS. 2, 3, and 4). The top veneer blank 40 can therefore be prepared from a thin veneer plate, thereby resulting in lower consumption of the expensive higher-quality wood material. Hence, the cost of producing the armrest of the present invention can be lowered.

3. Since the consumption of the expensive higher-quality wood material is low, the armrest of the present invention is very environmentally friendly.

Figure 8:
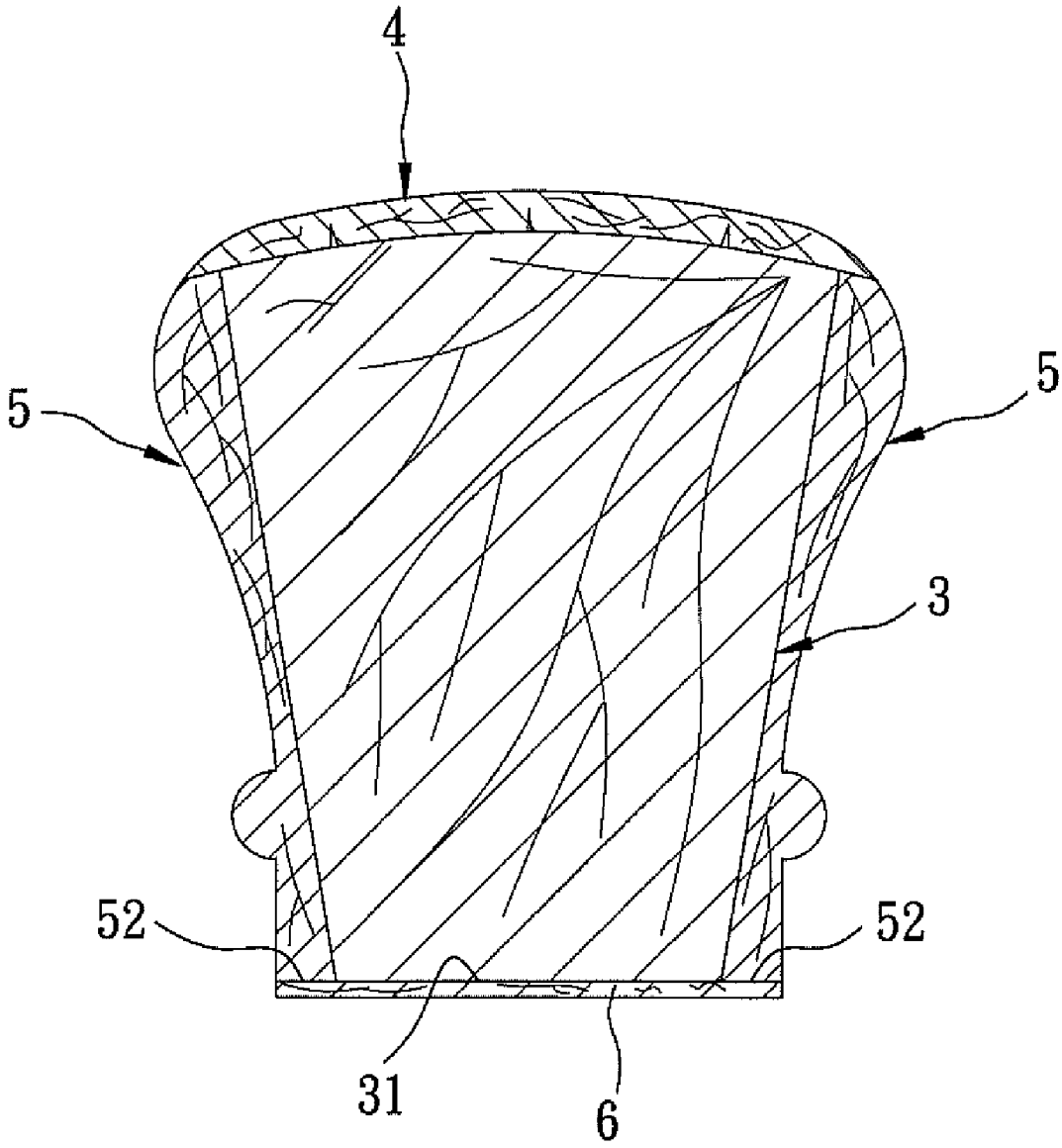
FIG. 8 is a sectional view of the second preferred embodiment of an armrest according to the present invention.
Figure 9:
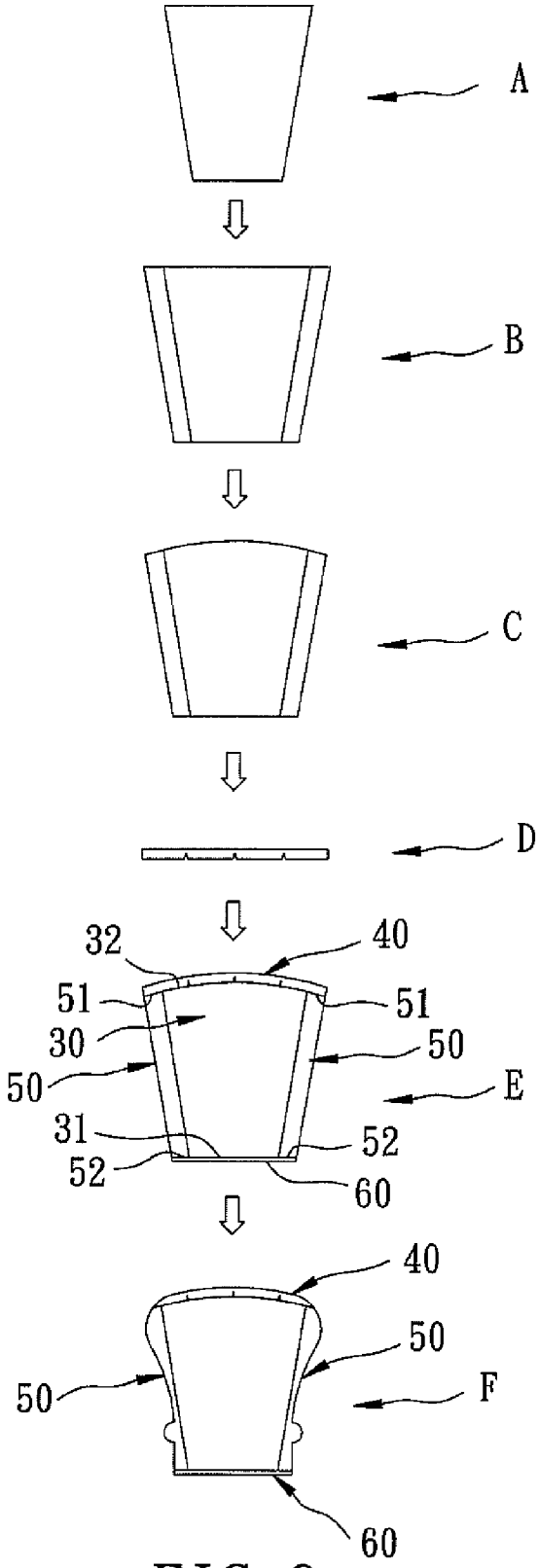
FIG. 9 illustrates the steps involved in producing the armrest of the second preferred embodiment.

Referring to FIGS. 8 and 9, the second preferred embodiment of an armrest according to the present invention is shown to be similar to the first preferred embodiment. However, in this embodiment, the armrest further comprises a bottom veneer layer 6 adhered to the bottom end faces 52 of the lateral veneer layers 5 and the bottom surface 31 of the longitudinal core body 3. Preferably, the bottom veneer layer 6 is made of a material similar to that of the top veneer layer 4.

The steps involved in producing the armrest of the second preferred embodiment are similar to those described in the first preferred embodiment. However, in step (E), aside from bending and adhering the top veneer blank 40 to the top surface 32 of the core blank 30 and the top end faces 51 of the lateral veneer blanks 50, a bottom veneer blank 60 is adhered to the bottom surface 31 of the core blank 30 and bottom end faces 52 of the lateral veneer blanks 50. Furthermore, instep (F), all of the top veneer blank 40, the lateral veneer blanks 50, and the bottom veneer blank 60 are contoured to have the shapes shown in FIG. 8. The advantages of the first preferred embodiment can be similarly attained by the second preferred embodiment.

Figure 10:
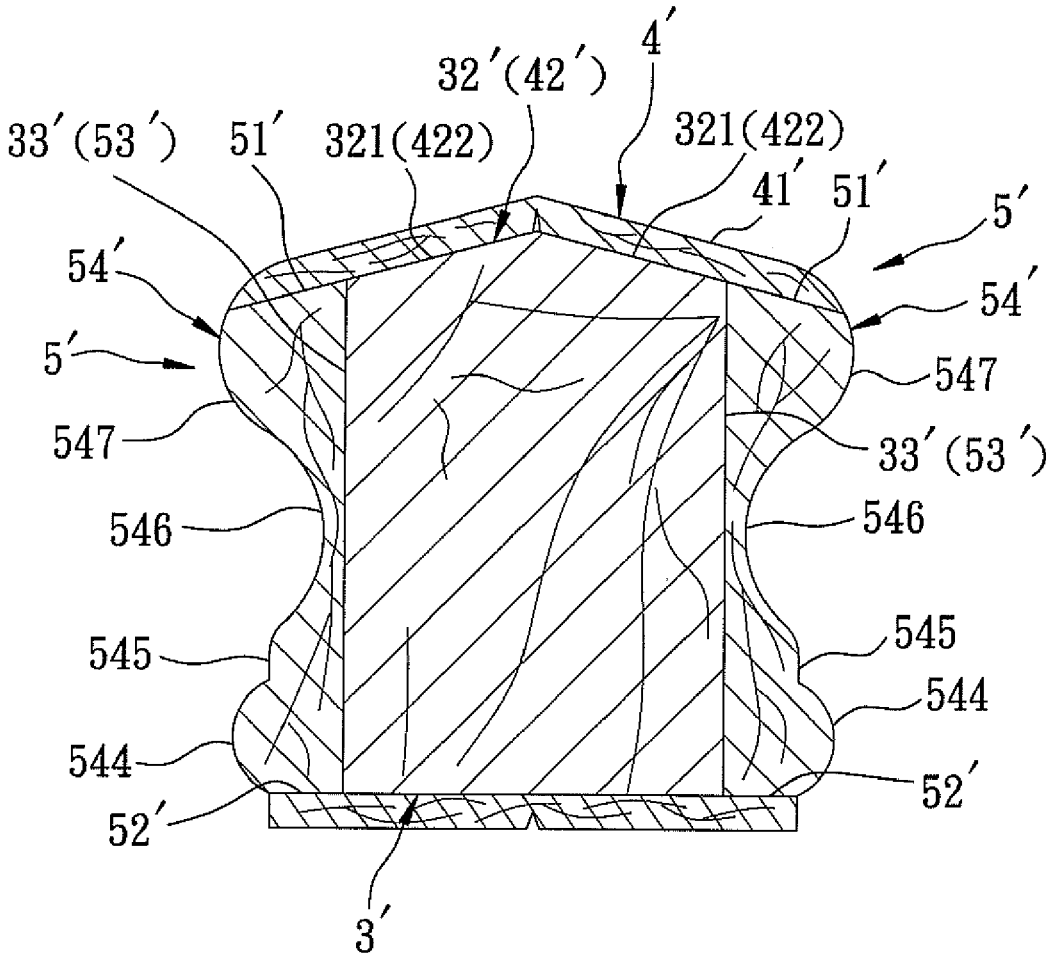
FIG. 10 is a sectional view of the third preferred embodiment of an armrest according to the present invention.
Figure 11:
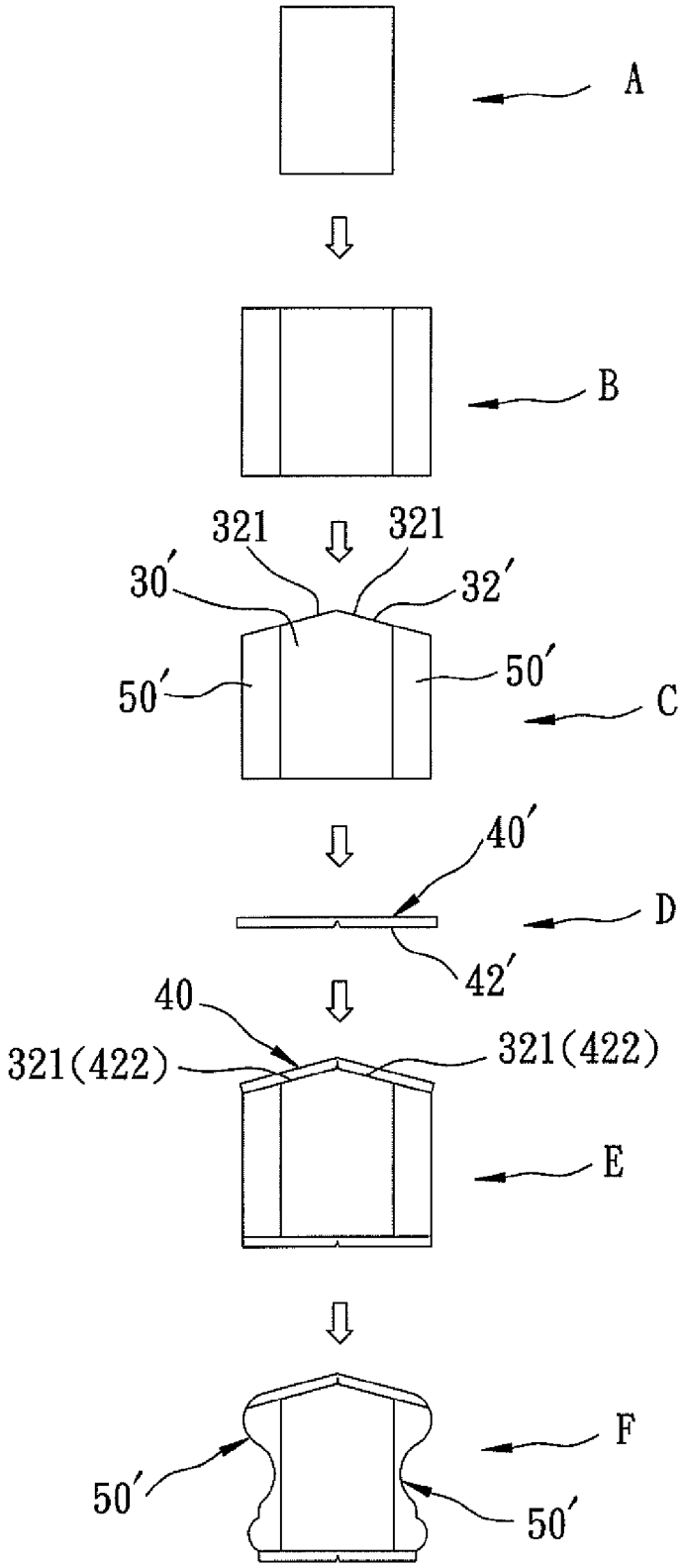
FIG. 11 illustrates the steps involved in producing the armrest of the third preferred embodiment.

Referring to FIGS. 10 and 11, the third preferred embodiment of an armrest according to the present invention is shown to be similar to the second preferred embodiment. However, in this embodiment, the top surface 32' of the longitudinal core body 3' has two interconnected inclined surface sections 321 that extend upwardly and toward each other respectively from the lateral surfaces 33' of the core body 3'. The bottom connecting surface 42' of the top veneer layer 4' has two interconnected inclined surface sections 422 that are inclined upward to extend toward each other and that are attached respectively to the inclined surface sections 321 of the top surface 32' of the core body 3'. Each of the top surface 41' and the bottom connecting surface 42' of the top veneer layer 4' has the same outline as that of the top surface 32' of the core body 3'. The outer lateral surface 54' of each lateral veneer layer 5' is formed with a projection 544, a planar surface section 545, an inward indented section 546, and a curved surface section 547. The projection 544 projects longitudinally and outwardly from the outer lateral surface 54', and has a bottom end connected to the bottom end face 52' of the corresponding lateral veneer layer 5'. The planar surface section 545 extends upwardly and longitudinally from a top end of the projection 544. The curved surface section 547 has a top end connected to the top end face 51' of the corresponding lateral veneer layer 5'. The inward indented section 546 is connected between a bottom end of the curved surface section 547 and a top end of the planar surface section 545.

The steps involved in producing the armrest of the third preferred embodiment are similar to those described in the second preferred embodiment. However, in step (C), the non-planar top surface 32' of the core blank 30' has two interconnected planar inclined surface sections 321. In step (E), the bottom connecting surface 42' of the top veneer blank 40' is bent so as to have two interconnected planar inclined surface sections 422 that are inclined upward to extend toward each other and that are adhered respectively to the inclined surface sections 321 of the core blank 30'. In step (F), the lateral veneer blanks 50' are contoured. The structure shown in FIG. 10 is finally formed.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An armrest comprising:

a longitudinal core body made of a lower-quality wood material, and having a substantially planar bottom surface, a non-planar top surface, and two opposite lateral surfaces interconnecting said bottom and top surfaces and extending longitudinally, said non-planar top surface rising upwardly from said lateral surfaces to a middle of said top surface, wherein said lower-quality wood material is selected from the group consisting of rubber wood, pinewood, cedar wood, defective high quality wood, and high density fiber material;

a top veneer layer made of a higher-quality wood material, and having a top surface, and a bottom connecting surface adhered to said top surface of said longitudinal core body, each of said top surface of said top veneer layer and said bottom connecting surface having substantially the same outline as that of said top surface of said core body, wherein said higher-quality wood material is selected from the group consisting of oakwood, maple wood, poplar wood, cherry wood, beech wood, alder wood, and hemlock wood; and two lateral veneer layers, each of which is made of a material similar to that of said top veneer layer, and has a top end face connected to said bottom connecting surface of said top veneer layer, a bottom end face opposite to said top end face, an inner lateral surface adhered to a respective one of said opposite lateral surfaces of said longitudinal core body, and an outer lateral surface opposite to said inner lateral surface;

wherein said top veneer layer is formed with a plurality of longitudinal grooves that extend upwardly from said bottom connecting surface to a level lower than said top surface of said top veneer layer and that are spaced apart from each other transversely of said longitudinal core body.

2. The armrest of claim 1, further comprising a bottom veneer layer adhered to said bottom surface of said longitudinal core body and said bottom end faces of said lateral veneer layers.

3. The armrest of claim 1, wherein each of said plurality of longitudinal grooves has a substantially triangular cross-section.

4. The armrest of claim 1, wherein said outer lateral surface of each of said two lateral veneer layers includes a projection extending longitudinally and projecting outwardly from said outer lateral surface, a curved surface section extending from a top end of said projection to said top end face of a respective one of said two lateral veneer layers, and a substantially planar surface section extending from a bottom end of said projection to said bottom end face of the corresponding one of said two lateral veneer layers.

5. The armrest of claim 1, wherein said top surface of said core body is convexed upward.

6. The armrest of claim 1, wherein said top surface of said longitudinal core body has two interconnected inclined surface sections that extend upwardly and toward each other respectively from said opposite lateral surfaces of said longitudinal core body, said bottom connecting surface of said top veneer layer having two interconnected inclined surface sections that are inclined upward to extend toward each other and that are attached respectively to said inclined surface sections of said top surface of said core body.

7. The armrest of claim 6, wherein said outer lateral surface of each of said lateral veneer layers is formed with a projection projecting longitudinally and outwardly and having a bottom end connected to said bottom end face of a respective one of said two lateral veneer layers, a planar surface section extending upwardly and longitudinally from a top end of said projection, a curved surface section having a top end connected to said top end face of the corresponding one of said two lateral veneer layers, and an inward indented section connected between a bottom end of said curved surface section and a top end of said planar surface section of said outer lateral surface.

8. The armrest of claim 1, wherein said top veneer layer includes a central portion having a thickness of not less than one millimeter.

9. The armrest of claim 1, wherein each of said lateral veneer layers has a smallest thickness of not less than one millimeter.

10. An armrest comprising:

a longitudinal core body made of a lower-quality wood material, and having a substantially planar bottom surface, a non-planar top surface, and two opposite lateral surfaces interconnecting said bottom and top surfaces and extending longitudinally, said non-planar top surface rising upwardly from said lateral surfaces to a middle of said top surface, wherein said lower-quality wood material is selected from the group consisting of rubber wood, pinewood, cedar wood, defective high quality wood, and high density fiber material;

a top veneer layer made of a higher-quality wood material, and having a top surface, and a bottom connecting surface adhered to said top surface of said longitudinal core body, each of said top surface of said top veneer layer and said bottom connecting surface having substantially the same outline as that of said top surface of said core body, wherein said higher-quality wood material is selected from the group consisting of oakwood, maple wood, poplar wood, cherry wood, beech wood, alder wood, and hemlock wood; and two lateral veneer layers, each of which is made of a material similar to that of said top veneer layer, and has a top end face connected to said bottom connecting surface of said top veneer layer, a bottom end face opposite to said top end face, an inner lateral surface adhered to a respective one of said opposite lateral surfaces of said longitudinal core body, and an outer lateral surface opposite to said inner lateral surface;

wherein said top veneer layer is formed with at least one longitudinal groove that extends upwardly from said bottom connecting surface to a level lower than said top surface of said top veneer layer.

* * * * *